US009121127B2

(12) United States Patent
Ponnaganti et al.

(10) Patent No.: US 9,121,127 B2
(45) Date of Patent: Sep. 1, 2015

(54) APPARATUS AND SYSTEM FOR ROTATING ELEMENTS IN AN APPLIANCE

(75) Inventors: Mohan Rao Ponnaganti, Andhra Pradesh (IN); Harikishor Koripoti, Andhra Pradesh (IN); David Scott Dunn, Smithfield, KY (US)

(73) Assignee: General Electric Company, Schenectady, NY (US)

( * ) Notice: Subject to any disclaimer, the term of this patent is extended or adjusted under 35 U.S.C. 154(b) by 986 days.

(21) Appl. No.: 13/153,004

(22) Filed: Jun. 3, 2011

(65) Prior Publication Data

US 2012/0304704 A1 Dec. 6, 2012

(51) Int. Cl.

| | |
|---|---|
| ***D06F 13/02*** | (2006.01) |
| ***D06F 23/04*** | (2006.01) |
| ***D06F 37/40*** | (2006.01) |

(52) U.S. Cl.

CPC ..... *D06F 37/40* (2013.01); *D06F 13/02* (2013.01); *D06F 23/04* (2013.01)

(58) Field of Classification Search

CPC ..... D06F 37/40; D06F 13/02; D06F 23/04
USPC ..... 68/140
See application file for complete search history.

(56) References Cited

U.S. PATENT DOCUMENTS

| | | | | |
|---|---|---|---|---|
| 2,161,604 | A * | 6/1939 | Watts | 68/12.02 |
| 4,371,067 | A | 2/1983 | Gerry | |
| 4,890,465 | A | 1/1990 | Burk et al. | |
| 5,000,016 | A | 3/1991 | Burk et al. | |
| 5,033,278 | A * | 7/1991 | Hossfield et al. | 68/23.7 |
| 5,269,160 | A | 12/1993 | Wood | |
| 5,345,793 | A | 9/1994 | Sharp | |
| 6,077,184 | A | 6/2000 | Lee | |
| 6,332,343 | B1 | 12/2001 | Koketsu et al. | |
| 7,028,512 | B2 | 4/2006 | Chang | |
| 7,197,783 | B2 | 4/2007 | Wilson et al. | |
| 2008/0060388 | A1 | 3/2008 | Warmuth | |

* cited by examiner

*Primary Examiner* — Joseph L Perrin
*Assistant Examiner* — Levon J Shahinian
(74) *Attorney, Agent, or Firm* — Dority & Manning, P.A.

(57) ABSTRACT

An apparatus is configured to facilitate in an appliance various operating modes including a spin mode and an agitation mode in a vertical-axis washing machine. The apparatus comprise a drive system with a shaft, on which is secured engagement features, and stops that are fixed with respect to the position of the engagement features. Engagement of the engagement features and the stops couple together elements of the appliance such as an agitation device and a wash basket. In one embodiment, the stops and engagement features are distributed on different contact planes located along the shaft, thereby permitting clockwise and counter-clockwise rotation of the shaft and the engagement features through an angle of at least about 180° and up to about 680°.

10 Claims, 13 Drawing Sheets

APPARATUS AND SYSTEM FOR ROTATING ELEMENTS IN AN APPLIANCE

BACKGROUND OF THE INVENTION

1. Field of the Invention

The subject matter disclosed herein relates generally to appliances, and more particularly, to an apparatus and system that is configured to couple together elements of the appliance for simultaneous motion, wherein the elements comprise in one embodiment a wash basket and an agitation device in a vertical-axis washing machine.

2. Description of Related Art

Some appliances such as household washing machines include a cabinet that houses an outer tub for containing wash and rinse water, a perforated wash basket within the tub, and an agitation device within the wash basket. A drive and motor assembly is mounted underneath the stationary outer tub to rotate the basket and the agitation device relative to one another. A pump assembly is also supplied to pump water from the tub to a drain to complete execution of a wash cycle.

The wash basket is utilized to execute centrifugal extraction of the wash and rinse water from the clothing items during spin cycles. The wash basket is rotated at a relatively high rate of rotation in order to cause centrifugal outward movement of the water from the wash basket into the outer tub. After being collected in the outer tub, the water is drained in preparation to initiate another cycle.

A transmission unit coupled to a single drive motor is often used to drive both the agitation device and the wash basket. The transmission is configured to produce high-speed rotation of the wash basket for the spin cycle and, often in a reverse direction of rotation of the drive motor, a slower speed oscillatory output that is transmitted to the agitation device to execute the necessary motion thereof. The oscillatory output is commonly achieved by use of a mechanical movement, which converts the unidirectional rotary motion of the drive motor into an oscillatory output of the agitation device. The mechanical movement necessary is complex in configuration and represents a relatively costly item in the transmission. Examples utilize positively activated clutches and solenoids, which not only require power, but also add cost, design complexity, and may induce reliability and service issues.

There is therefore a need for a drive system that is configured for use in appliance such as washing machines and that are configured to provide outputs that enable the various spin and oscillatory dynamics for the agitation device and the wash basket, but that does so in a less costly, simple, and reliable manner.

BRIEF SUMMARY OF THE INVENTION

In one embodiment, an apparatus comprises a drive system comprising an outer housing through which extends a shaft and in which is disposed a first stop, a second stop, and engagement features. The engagement features are coupled to the shaft and radially offset from the shaft a distance that permits contact between the engagement features and the first stop and the second stop. The first stop and the second stop are located on different contact planes spaced along a longitudinal axis of the shaft.

In another embodiment, a drive system comprises a planetary gear train enclosed in an outer housing. The planetary gear train comprises a ring gear secured to the outer housing and a sun gear secured to a shaft with a longitudinal axis and that extends through the outer housing. The drive system also comprises a carrier plate secured to the shaft and on which is disposed a first engagement feature and a second engagement feature. The drive system further comprises a first stop and a second stop fixed in the outer housing with respect to the first engagement feature and the second engagement feature. The first stop and the second stop each have a first face and a second face against which one of the first engagement feature and the second engagement feature is configured to contact. The first stop and the second stop are located on different contact planes spaced along the longitudinal axis of the shaft.

In yet another embodiment, an appliance comprises a wash basket in which objects can be positioned to be washed and an agitation device disposed in the wash basket. The appliance also comprises a drive system coupled to each of the wash basket and the agitation device. The drive system comprises an outer housing and a shaft with a longitudinal axis that extends through the outer housing to impart rotation to the agitation device. The outer housing has enclosed therein engagement features coupled to the shaft at a radial offset that permits contact with stops that are affixed to the outer housing and on which are disposed faces at which contact with the engagement features is made. The stops are located on different contact planes spaced along a longitudinal axis of the shaft.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
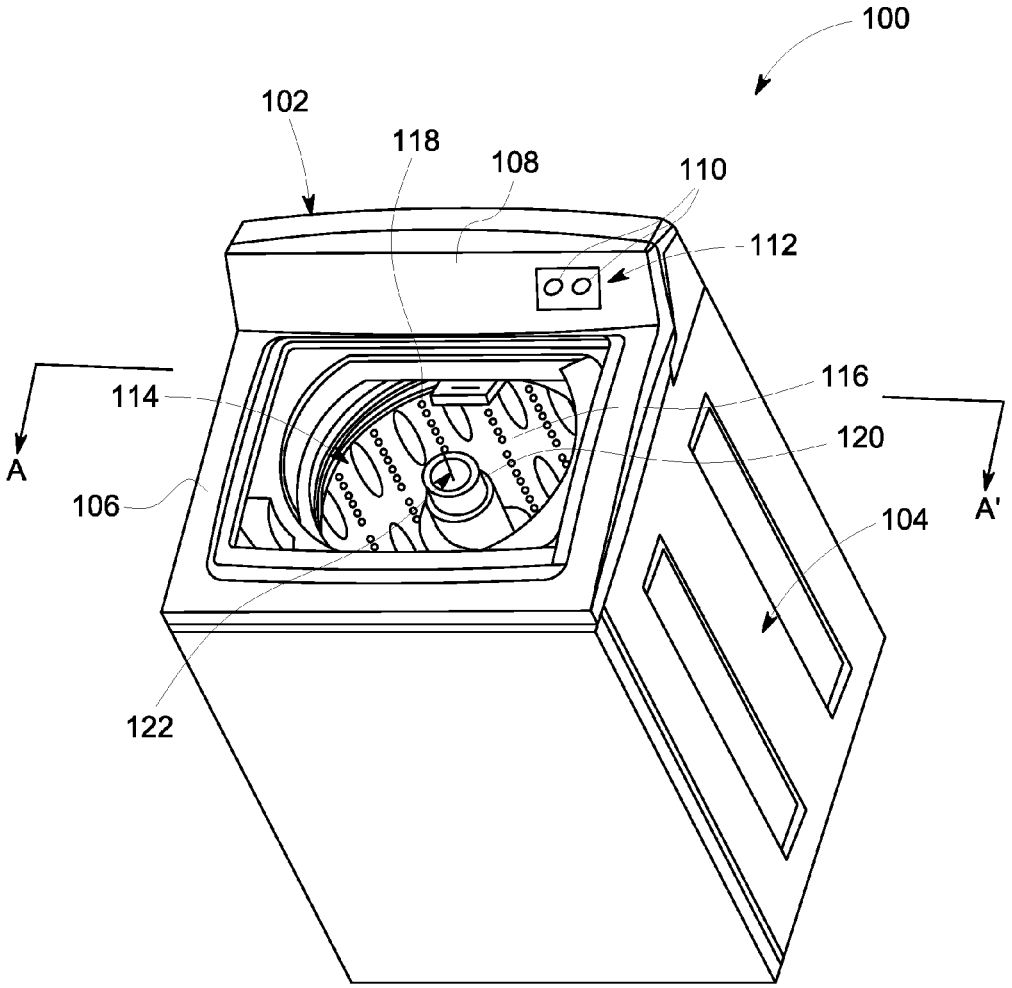
FIG. 1 is a top, perspective view of an exemplary embodiment of an appliance.
Figure 2:
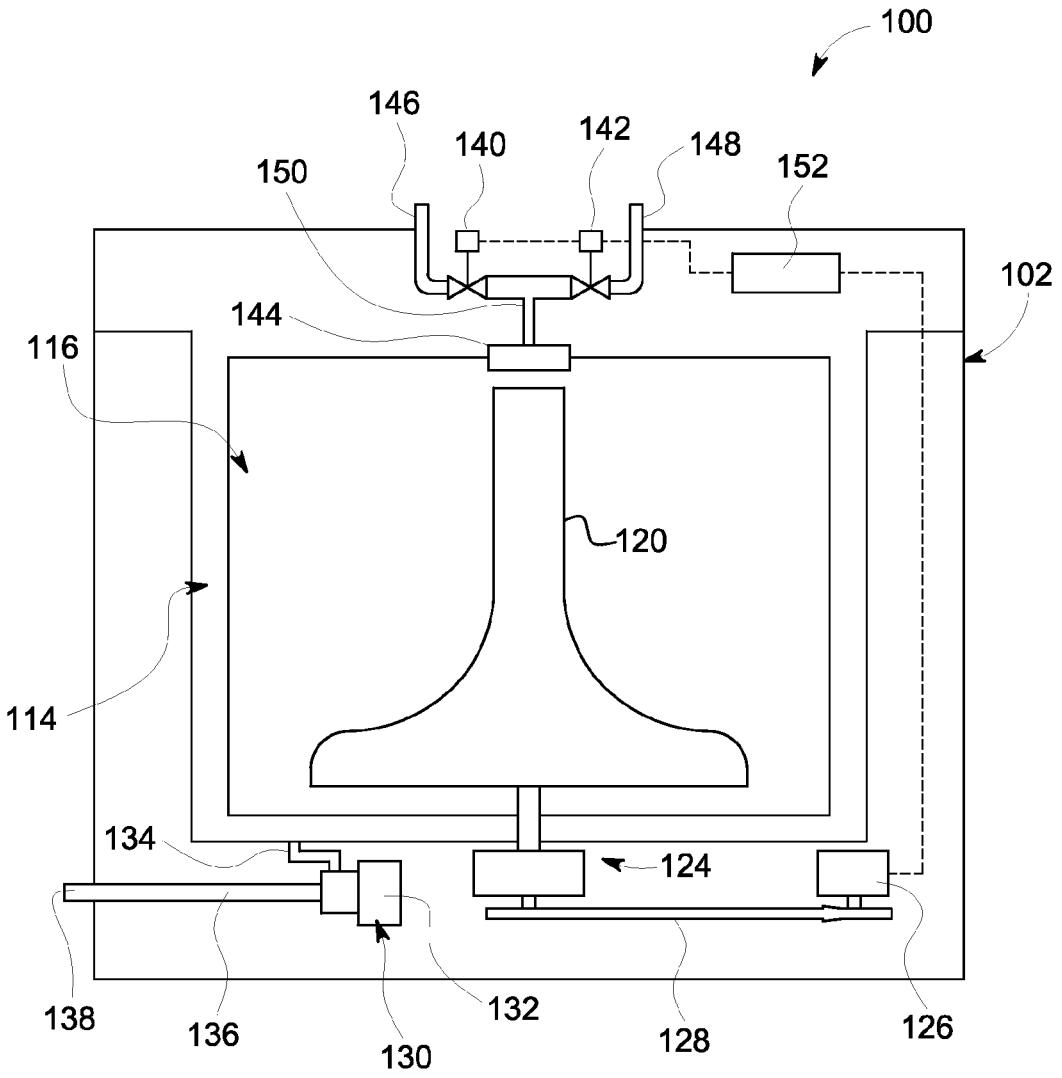
FIG. 2 is a side, schematic view of the appliance of FIG. 1.

FIG. 1 depicts a perspective view and FIG. 2 depicts a cross-section view, along line A-A' of FIG. 1, of an exemplary embodiment of an appliance 100. In this example, the appliance 100 is a vertical-axis washing machine 102 (or "washing machine 102") that is made in accordance with the concepts of the present invention. It is contemplated, however, that at least some of the benefits of the concepts recited herein can be realized in other types of appliances, such as horizontal-axis washing machines. These concepts are therefore not intended to be limited to any particular type or configuration of the appliance 100, such as the configuration and features of the washing machine 102.

The washing machine 102 has a cabinet 104 and a cover 106. A backsplash 108 extends from the cover 106 and a variety of control input selectors 110 are coupled to the backsplash 108. The control input selectors 110 form a user interface 112 for operator selection of machine cycles and features. A wash tub 114 is located within the cabinet 104. Inside of the wash tub 114 is a wash basket 116, which is movably disposed and rotatably mounted in the wash tub 114 in a spaced apart relationship from wash tub 114. The wash basket 116 has a plurality of perforations 118 to facilitate egress of fluid out of the wash basket 116 when the wash basket 116 is rotated. An agitation device 120 (or impeller or oscillatory basket mechanism) is rotatably positioned in the wash basket 116 on a vertical axis 122, which is substantially aligned and coincident with a center axis (not shown) of the wash basket 116.

As best depicted in FIG. 2, in one embodiment, the washing machine 102 uses a drive system 124, which is described in more detail below, a motor 126, and a transmission belt 128. The drive system 124 facilitates driving engagement of the wash basket 116 and the agitation device 120 such as to cause rotation of each of the wash basket 116 and the agitation device 120. The transmission belt 128 couples the drive system 124 to the motor 126 through respective pulleys and shafts. In operation, the drive system 124 transfers power from the motor 126 to the wash basket 116 and the agitation device 120.

In one embodiment, the drive system 124 rotates the wash basket 116 and the agitation device 120 as necessary to implement various modes of operation in the washing machine 102. These modes include, for example, an agitation mode in which the agitation device 120 imparts oscillatory motion to articles and/or liquid in the wash basket 116. Another mode is a spin mode in which the wash basket 116 and the agitation device 120 rotate simultaneously and/or in conjunction with one another.

Various constructions of the drive system 124 are proposed that effectuate changes among and between these operating modes, with particular emphasis on the implementation of the agitation mode and the spin mode, and vice versa. In one embodiment the agitation device 120 rotates independent of the wash basket 116 through an angle of rotation of at least about 340°, and in one example the agitation device 120 rotates independently up to about 680°. Continued rotation through this upper limit (e.g., 340° and/or 680°) thereafter causes the agitation device 120 and the wash basket 116 to rotate together such as is desired in the spin mode or related portion of a wash cycle in which the wash basket is to rotate. However, the inventors note that, unlike conventional solutions, the coupling of the wash basket 116 and the agitation device 120 does not require clutches (e.g., solenoids and electro-magnetic clutches), timing belts, brakes (e.g., band brakes), and related devices.

Referring back to FIG. 2, to further effectuate operation of the appliance 100, the washing machine 102 comprises a pump assembly 130 beneath the wash tub 114 and the wash basket 116 for gravity assisted flow when draining the wash tub 114. The pump assembly 130 includes a pump/motor 132 and in an exemplary embodiment a motor fan (not shown). A pump inlet hose 134 extends from the wash tub 114 to the pump/motor 132 and a pump outlet hose 136 extends from the pump/motor 132 to a drain outlet 138 and ultimately to a building plumbing system discharge line (not shown) in flow communication with the drain outlet 138. In one implementation, pump assembly 130 is selectively activated to remove liquid from the wash tub 114 and the wash basket 116 through drain outlet 138 during appropriate points in washing cycles as the washing machine 102 is operated.

A hot liquid valve 140 and a cold liquid valve 142 deliver fluid, such as water, to a spray device 144 through a respective hot liquid hose 146 and a cold liquid hose 148. Liquid valves 140, 142 and liquid hoses 146, 148 together form a liquid supply connection for the appliance 100 and, when connected to a building plumbing system (not shown), provide a water supply for use in the appliance 100. Liquid valves 140, 142 and liquid hoses 146, 148 are connected to a basket inlet tube 150, which is coupled to the spray device 144, and fluid is dispersed from the basket inlet tube 150 through the spray device 144 into the wash basket 116.

Operation of the appliance 100 can be controlled by a controller 152. For example, the controller 152 can be operatively connected to the user interface 112 (FIG. 1) located on the backsplash 108 (FIG. 1) for user manipulation to select washing machine cycles and features. In response to user manipulation of the user interface 112, the controller 152 outputs signals to control and operate the various components of the washing machine 102 and to execute selective machine cycles and features.

Figure 3:
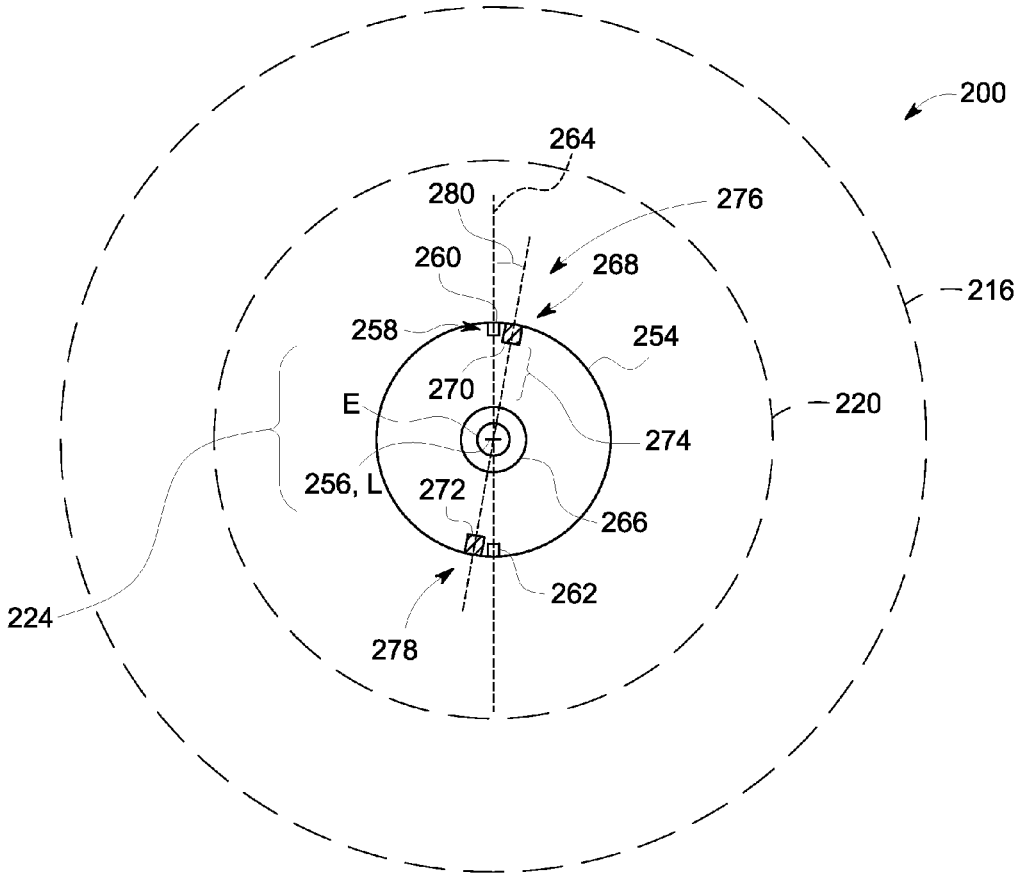
FIG. 3 is a top, schematic view of another exemplary embodiment of an appliance.
Figure 4:
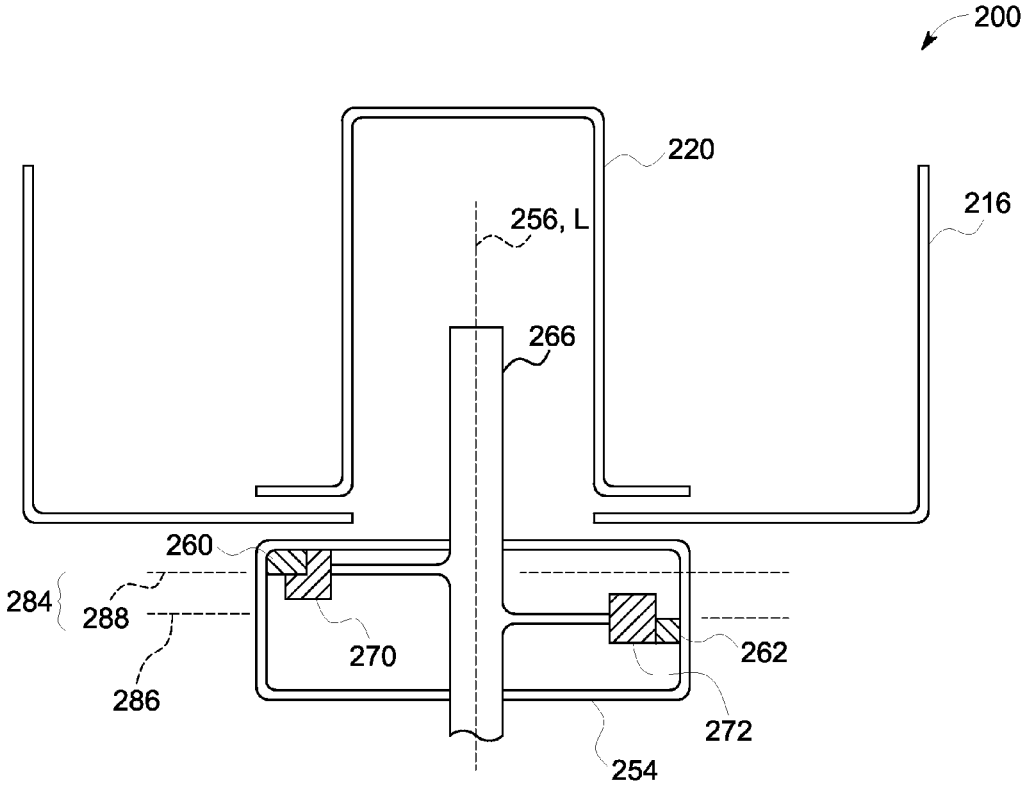
FIG. 4 is a side, schematic view of the appliance of FIG. 3.

With particular focus on the configuration, operation, and implementation of the drive system 124, and to further illustrate the concepts associated therewith, reference is now directed to FIGS. 3 and 4 in which a schematic diagram of another exemplary embodiment of an appliance 200 is depicted. Like numerals are used to identify like components as between FIGS. 1 and 2 and 3 and 4, except the numerals in FIGS. 3 and 4 are increased by 100. For example, in FIG. 3 it is shown that the appliance 200 has a wash basket 216 and an agitation device 220. The appliance 200 also has a drive system 224, which is configured to effectuate operation of the appliance 200 such as operation in at least the spin mode and the agitation mode described briefly above.

The drive system 224 comprises an outer housing 254, which in one example has a center axis 256. One or more stops 258 such as a first stop 260 and a second stop 262 are disposed on or coupled with an interior portion of the outer housing 254. The stops 258 are aligned on an axis 264 that is perpendicular to and passes through the center axis 256. Aligned with the center axis 256 is the longitudinal axis (L) of a shaft 266, which can rotate relative to the outer housing 254. There is secured to the shaft 266 one or more engagement features 268 such as a first engagement feature 270 and a second engagement feature 272. The engagement features 268 are displaced from the shaft 266 by a pre-determined distance, e.g., a radial offset 274, and are positioned to contact the stops 258.

Rotation of the shaft 266 about the center axis 256 places the engagement features 268 in various positions relative to the stops 258. These positions include a first contact position 276 and a second contact position 278, wherein each describes a location in which contact occurs between the stops 258 and the engagement features 268. The location of each position is defined by an angle 280 (also referred to herein as the "angle of agitation") that defines the angular displacement of the engagement features 268 relative to the stops 258. In the present example, the angle 280 measures the angular offset of the stops 258 from the axis 264 on which the stops 258 are aligned. However, the inventors recognize that the origin of the angle 280 can/will vary based on certain characteristics of the drive system 224 including, but not limited to, the construction of the various embodiments contemplated herein. Moreover, rotation of the shaft 266 will change the position of the engagement features 268. For example, as the shaft 266 rotates, the engagement features 268 will travel or "sweep" to various locations between the first contact position 276 and the second contact position 278. This sweeping action occurs as a result of rotation of the shaft 266 that occurs during the agitation mode.

Also shown in FIG. 3, the drive system 224 can further comprise an encoder E (either internal or external) or related device or component that is useful to measure the angle of agitation. Devices such as encoders are useful to prevent the engagement features 268 from contacting the stops 258 at high rate of rotation, thereby limiting undesirable noise or damage that might occur as a result of such high-velocity engagement or collisions. Encoders are commonly used in connection with motors, shafts, and rotating systems, therefore details of such devices is not necessary. In one construction, the encoder can monitor the position or the amount of rotation of the shaft 266. In alternative constructions, the encoder or related device can be secured to the motor, whereby the encoder monitors the position of, e.g., the motor shaft.

When implemented in the appliance 200, the outer housing 254 is secured to the wash basket 216 and the shaft 266 is secured to the agitation device 220. One or more of these components can be secured directly to each other using known fasteners and techniques. However, other examples are also contemplated in which one or more intervening components are used to transfer motion from, e.g., the outer housing 254 to the wash basket 216. Examples of intervening components include pulleys, gears, and belts, the size and configuration of which will vary as necessary to achieve desired performance characteristics (e.g., angular velocity and/or torque) for the wash basket 116, the agitation device 120, as well as the appliance 200 generally.

For operating the appliance 200 in the agitation mode the shaft 266 is rotated bi-directionally (e.g., clockwise and counter-clockwise) through the angle 280. The amount of rotation is often associated with one or more pre-determined settings, which are likewise associated with desired operation and selected operational cycles for the appliance 200. Values for the angle 280 are typically greater than about 90° in each direction, and in one example these values are from about 90° to about 680°. Again one of the benefits of the concepts proposed herein is that the inventors have identified solutions that permit values of the angle 280 of about 340° during both clockwise and counter-clockwise actuation in the agitation mode. Other constructions are also contemplated in which the angle 280 is greater than 340°.

As best depicted in FIG. 4, to effectuate the various angles of agitation (e.g., the angle 280 (FIG. 3)) including those angles of at least, e.g., 340°, and in excess thereof, configurations of the drive system 224 comprise a plurality of contact planes 284 displaced along the center axis 256 and/or spaced apart along the longitudinal axis (L) of the shaft 266. The contact planes 284 include a lower contact plane 286 and an upper contact plane 288 on which engagement can occur as between the stops 258 and the engagement features 268. To facilitate engagement between these elements, one or more of the stops 258 and the engagement features 268 are positioned on or proximate the contact planes 284. In one embodiment, the first stop 260 and the first engagement feature 270 are located on the upper contact plane 288 and the second stop 262 and the second engagement feature 272 are located on the lower contact plane 286. This configuration permits rotation of the shaft 266 through at least 180° where, in one example, movement of the engagement features 268 from the first contact position 276 to the second contact position 278 is possible because the first engagement feature 270 and the second stop 262 are located on different ones of the contact planes 284. In other words, the engagement feature positioned on or near the upper contact plane 288 will miss the stop positioned on the lower contact plane 286 during rotation of the shaft 266.

Examples of the construction of drive systems such as the drive system 124 (FIGS. 1 and 2) and the drive system 224 (FIGS. 3 and 4) are described next with reference to FIGS. 5-13. These constructions incorporate certain components that are useful to embody the concepts described above. However, implementation of these concepts is not limited to these components and thus the discussion that follows is provided for explanatory purposes and is not limiting as to the scope and spirit of the subject matter recited herein.

Figure 5:
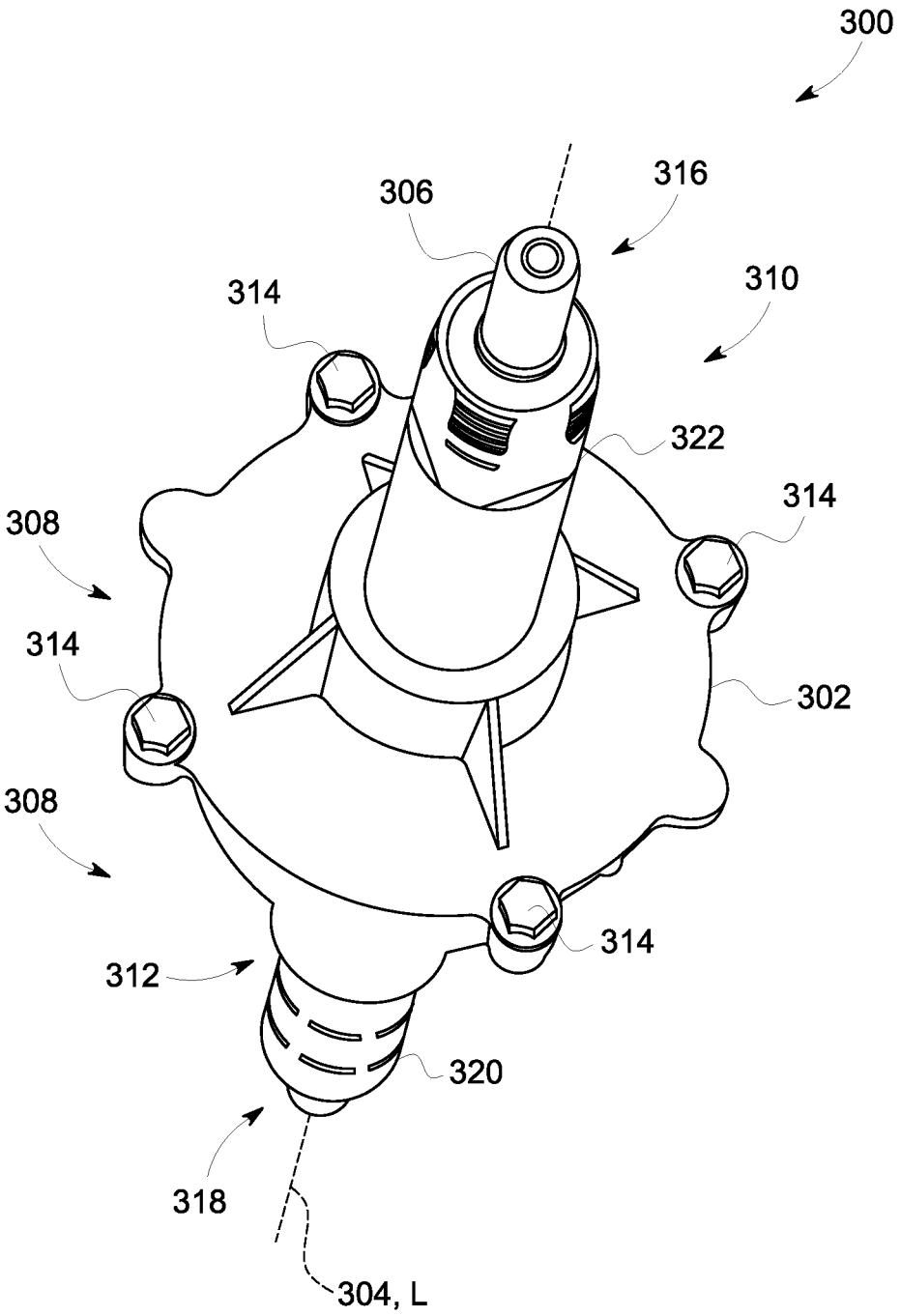
FIG. 5 is a top, perspective view of an example of a drive system for use in an appliance such as the appliances of FIGS. 1-4.

Turning first to FIG. 5, there is depicted an example of a drive system 300 that comprises an outer housing 302 with a center axis 304 on which is aligned the longitudinal axis (L) of a shaft 306. The outer housing 302 includes one or more housing elements 308 such as an upper housing element 310 and a lower housing element 312. Fasteners 314 such as screws and/or bolts are used to secure together the housing elements 308, thereby enclosing in the outer housing 302 the various components used to facilitate the agitation mode and the spin mode.

The shaft 306 has an upper portion 316, which is coupled to an agitation device (not shown), and a lower portion 318 that extends in a direction substantially opposite to the direction of the upper portion 316. The lower portion 318 is configured with, in one example, a drive element 320 such as a pulley, gear, or other element that is configured, to transmit motion, e.g., rotation, from sources outside of the drive system 300 to the agitation device via the shaft 306. Surrounding the upper portion 316 is a spin tube 322, which is coupled to the upper housing element 310 and, in one example, to a wash basket (not shown).

Construction of the outer housing 302 can employ a variety of materials and manufacturing processes, each being selected to provide the general configuration and arrangement of the features disclosed herein. The outer housing 302, as well as other components of the drive system 300, is amenable, for example, to materials such as metals, plastics, and composites, and more particularly to those materials that are typically related to consumer goods and devices. Therefore selection is often dictated by factors such as cost, size, shape, and reliability. In one example, the outer housing 302 is constructed as an assembly, wherein the various members (e.g., the housing elements 308) are formed as separate pieces that are assembled together with fasteners (e.g., fasteners 314). In other examples, construction is contemplated wherein one or more of the shaft 306 and housing elements 308 are formed as a single unitary and/or monolithic structure.

In one implementation, a motor (e.g., the motor 126 (FIG. 2)) is used to turn the drive element 320. This motor imparts rotation to the shaft 306 and, more particularly, causes angular displacement of the upper portion 316. Clockwise and counter-clockwise rotation of the drive element 320 causes similar motion in the agitation device, thereby implementing the agitation mode and, e.g., imparting motion to objects in the wash basket (e.g., the wash basket 116 (FIG. 1)).

Figure 6:
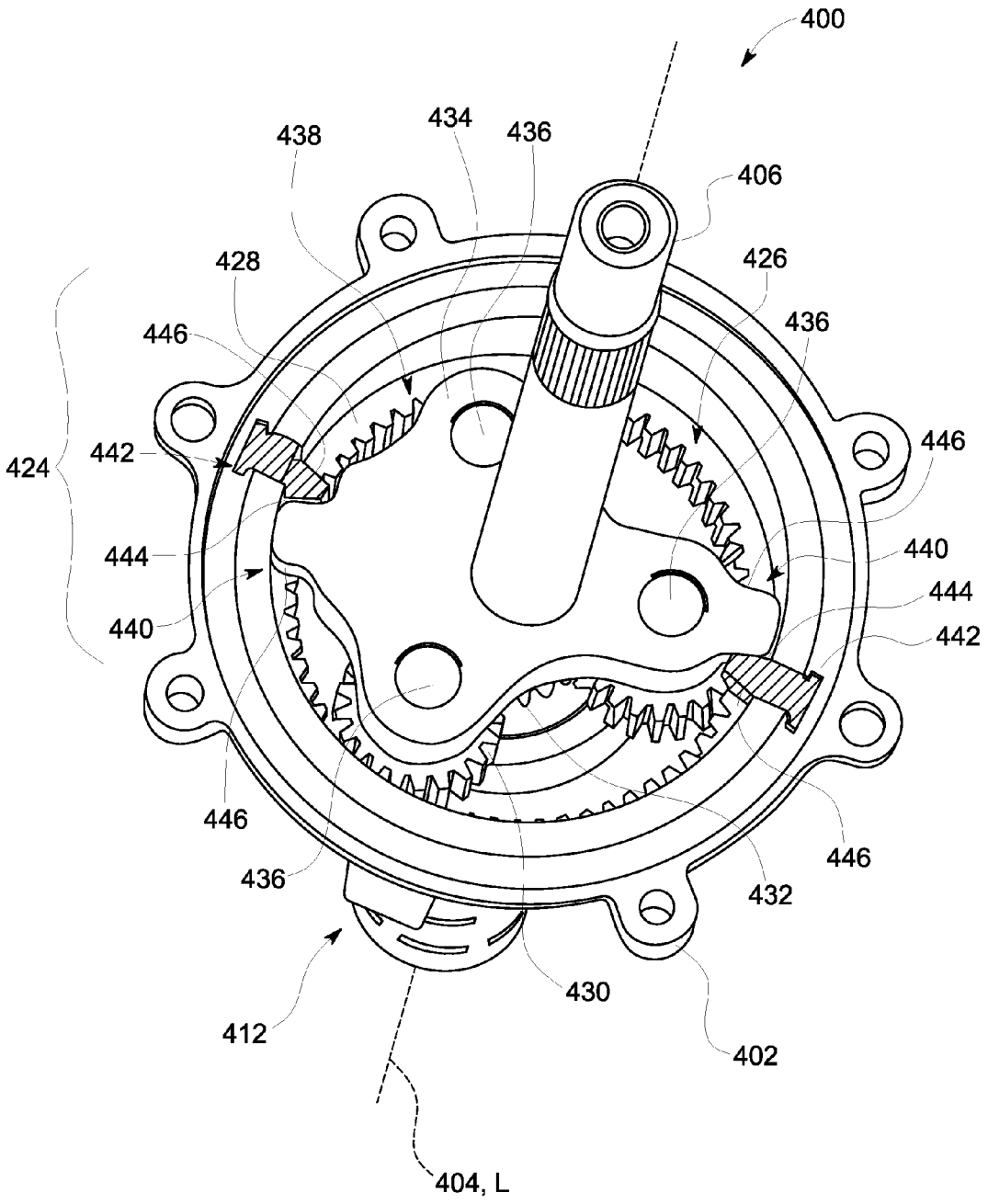
FIG. 6 is a top, perspective, cross-section view of another example of a drive system for use in an appliance such as the appliances of FIGS. 1-4.
Figure 7:
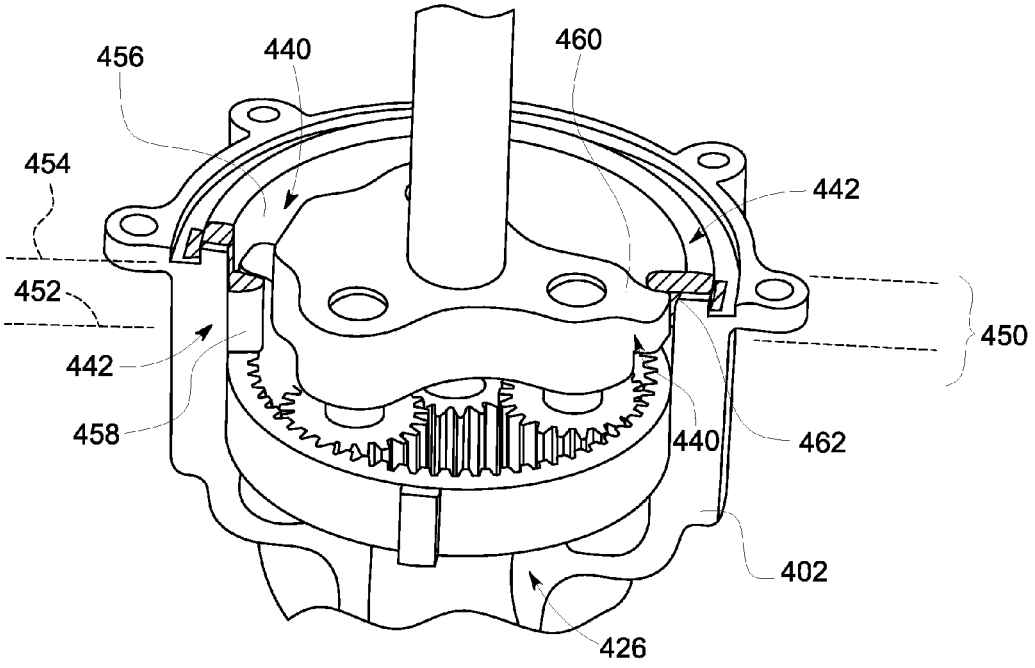
FIG. 7 is a side, cross-section view of the drive system of FIG. 6.

Considering now the construction internal to the outer housing (e.g., the outer housing 302), reference is directed to FIGS. 6 and 7 and the example of a drive system 400 depicted therein. Like numerals are used to identify like components as between FIGS. 5 and FIGS. 6 and 7, except the numerals in FIGS. 6 and 7 are increased by 100. For example, in FIG. 6 the drive system 400 comprises an outer housing 402 with a center axis 404, a shaft 406, and a lower housing element 412. Moreover, while some components have been removed for clarity, it is contemplated that these components and their derivatives are compatible with the various embodiments and configurations of drive systems disclosed herein.

In one embodiment, the drive system 400 has a drive train 424 such as a planetary gear train 426. The drive train 424 has a ring gear 428, planet gears 430, and a sun gear 432. In one example the sun gear 432 is secured to the shaft 406. Also secured to the shaft 406 is a carrier plate 434 to which is secured the planet gears 430 by way of pins 436. The carrier plate 434 has a form factor 438 with engagement features 440 (e.g., engagement features 268 (FIG. 2) that are configured to engage one or more stops 442 (e.g., stops 258 (FIG. 2) located on the periphery of the outer housing 402. To facilitate engagement, each of the engagement features 440 and the stops 442 have a first face 444 (or "clockwise face 444") and a second face 446 (or "counter-clockwise face 446"), a portion of each being located along an annular path (not shown) that is coincident with the center axis 404 and on which engagement can occur.

FIG. 7 illustrates in cross-section the drive system 400, and more particularly it is shown that the drive system 400 includes contact planes 450 on which are located the engagement features 440 and the stops 442. The contact planes 450 include a lower contact plane 452 and an upper contact plane 454. In one embodiment, a first engagement feature 456 and a first stop 458 are positioned along the lower contact plane 452 and a second engagement feature 460 and a second stop 462 are positioned along the upper contact plane 454.

The drive train 424 (which may include the drive element 320 (FIG. 3)) is not limited to the particular configuration of gears illustrated and described in the present disclosure. Rather configurations of the drive train 424, such as embodied by the planetary gear train 426 in the drive system 400, are selected to transmit sufficient output from the motor (e.g., the motor 126) to the wash basket (e.g., the wash basket 116) and the agitation device (e.g., the agitation device 120). Characterization of the output is, in one embodiment, associated with the rotational velocity of the wash basket and/or the torque necessary to agitate the objects in the wash basket. While each of the velocity and torque can vary, one example of the drive train 424 is configured to achieve rotational velocity of at least about 60 RPM and torque of at least about 20 N*m.

Elements such as the gears (e.g., the ring gear 428, the planet gears 430, the sun gear 432) and the outer housing 402 and the shaft 406 are sized and configured to achieve the rotational velocity and the torque that are desired for operation of the appliance. Gear ratios that are often utilized in connection with appliances such as vertical-axis washing machines are from about 9:1 to about 15:1. In one implementation, the ratio for the drive train 424 is about 12:1, and more particular to the drive system 400, gears for the planetary gear train 426 are sized accordingly such as in a ratio of 3:1 belt ratio and 4:1 sun gear-to-ring gear ratio.

As to the general construction, while separate gears can be used for the planetary gear train 426, it is also contemplated that features consistent with, e.g., the ring gear 428, can be incorporated into the outer housing 402. Moreover, elements such as bearings and bushings, which are not illustrated in the present figures, may be incorporated to provide sufficient support and robust design as required. In this connection, in one embodiment, the outer housing 402 is constructed so as to retain lubricants and other materials inside of the outer housing 402, thereby providing a substantially sealed environment in which can operate the gears, shaft, and other mechanisms.

Figure 8:
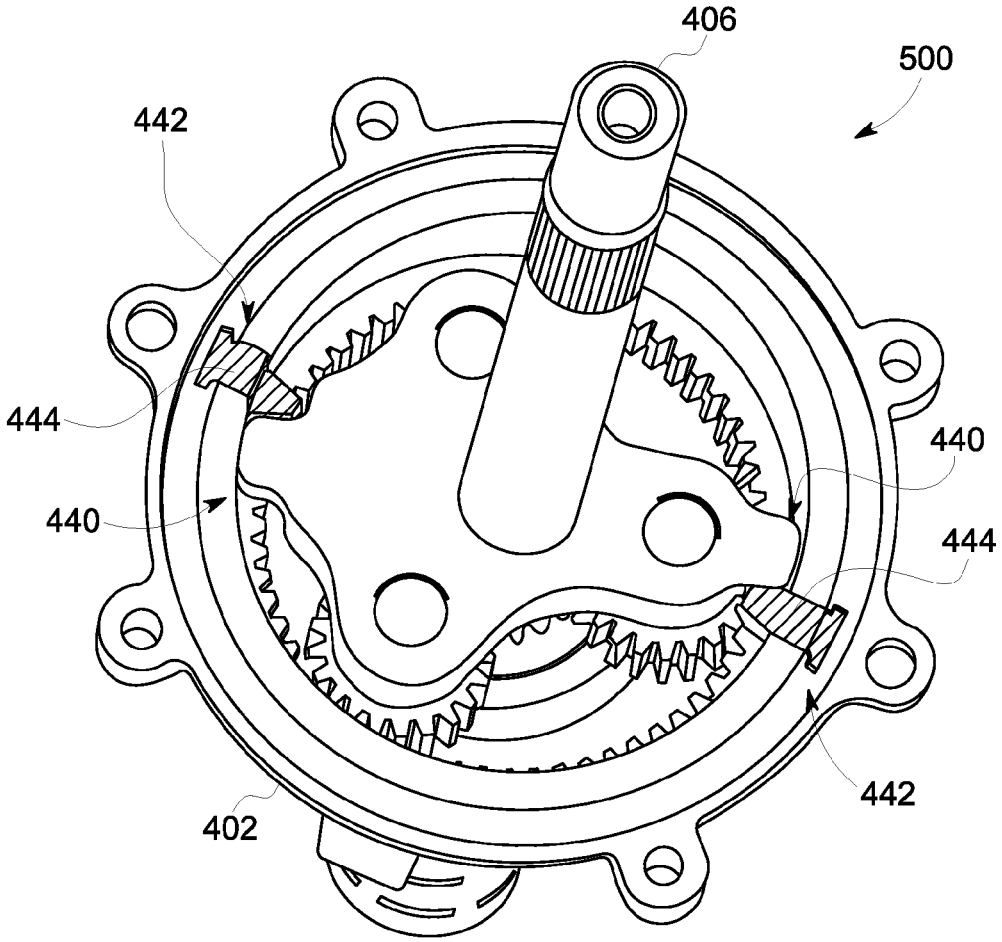
FIG. 8 is a top view of the drive system of FIGS. 6 and 7 in a first contact position.
Figure 9:
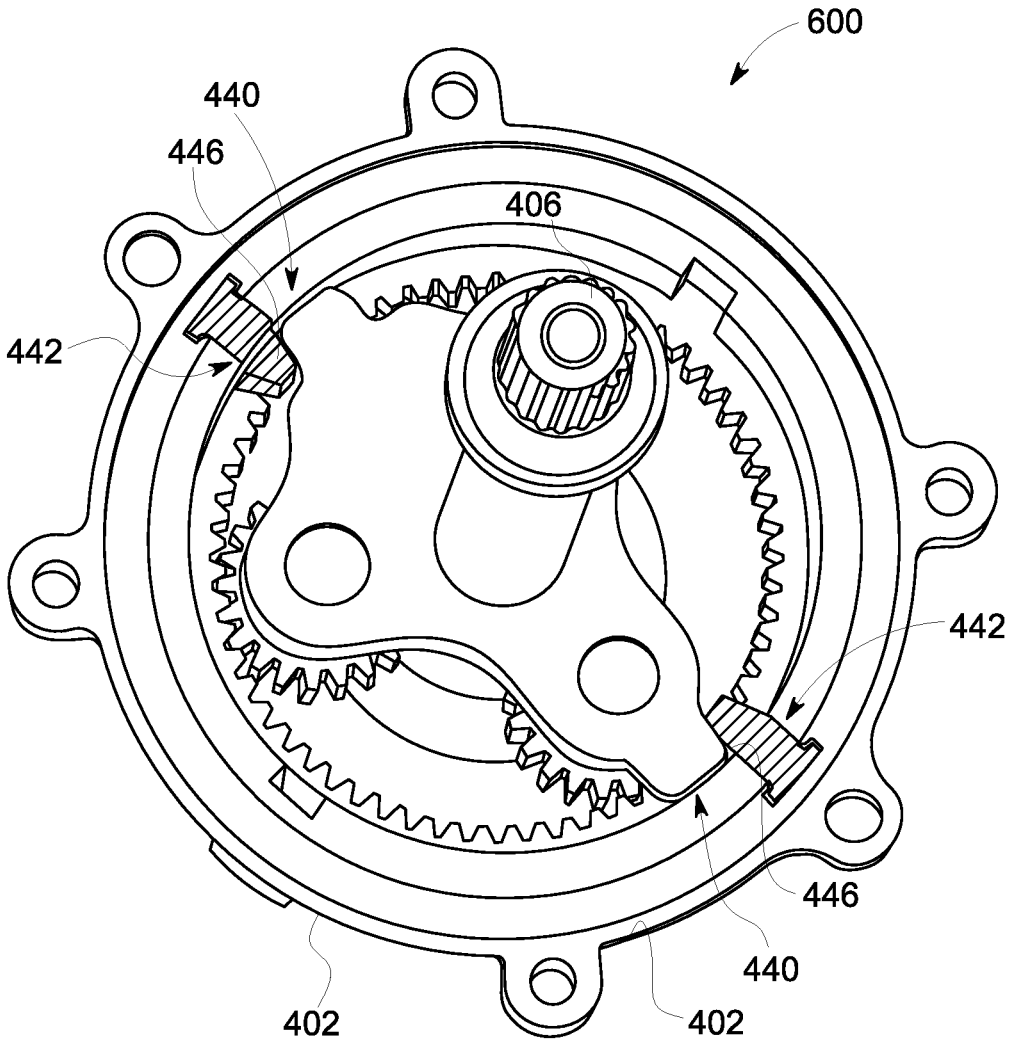
FIG. 9 is a top view of the drive system of FIGS. 6 and 7 in a second contact position.

With continued reference to the drive system 400 of FIGS. 6 and 7, and as best depicted in FIGS. 8 and 9, the drive system 400 can position the engagement features 440 in a plurality of positions including a first contact position 500 (FIG. 8) and a second contact position 600 (FIG. 9). Each of the positions is indicative of positions of the engagement features 440 that would occur during the agitation mode and the spin mode (and other modes) as defined by operation of washing machines as described and contemplated herein. Rotation of the shaft 406 in one direction (e.g., the clockwise direction or the counter-clockwise direction) will change the position of the engagement features 440 to, from, and between one or more of the first contact position 500 (FIG. 8) and the second contact position 600 (FIG. 9). The inventors note that the first face 444 of each of the engagement features 440 and the stops 442 are in contact with one another in the first contact position 500 (FIG. 8). Likewise the second face 446 of each of the engagement features 440 and the stops 442 are in contact with one another in the second contact position 600 (FIG. 9). In one embodiment, rotation engages and causes the outer housing 402 to rotate, which will cause the wash basket (not shown) to rotate as would normally occur during the spin mode. On the other hand, rotation of shaft 406 in the opposite direction will disengage or decouple the outer housing 402 and allow the shall 406 rotate freely within the outer housing 402. Free rotation of the shaft 406 will continue so long as the engagement features 440 are located between the first contact position 500 (FIG. 8) and the second contact position 600 (FIG. 9).

In one embodiment, the first face 444 and the second face 446 are fixed in position, i.e., the stops 442 are fixedly secured to the outer housing 402. This configuration is beneficial to facilitate rotation of the engagement features 440 of about 340° as between the first contact position 500 (FIG. 8) and the second contact position 600 (FIG. 9). The amount of rotation can vary in connection with the shape and construction of one or more of the engagement features 440 and the stops 442. In one example, to permit rotation of less than 340° the dimensions of the stops 442 are changed, thereby reducing the amount of angular displacement that is available for the engagement features to rotate in the outer housing 402.

Figure 10:
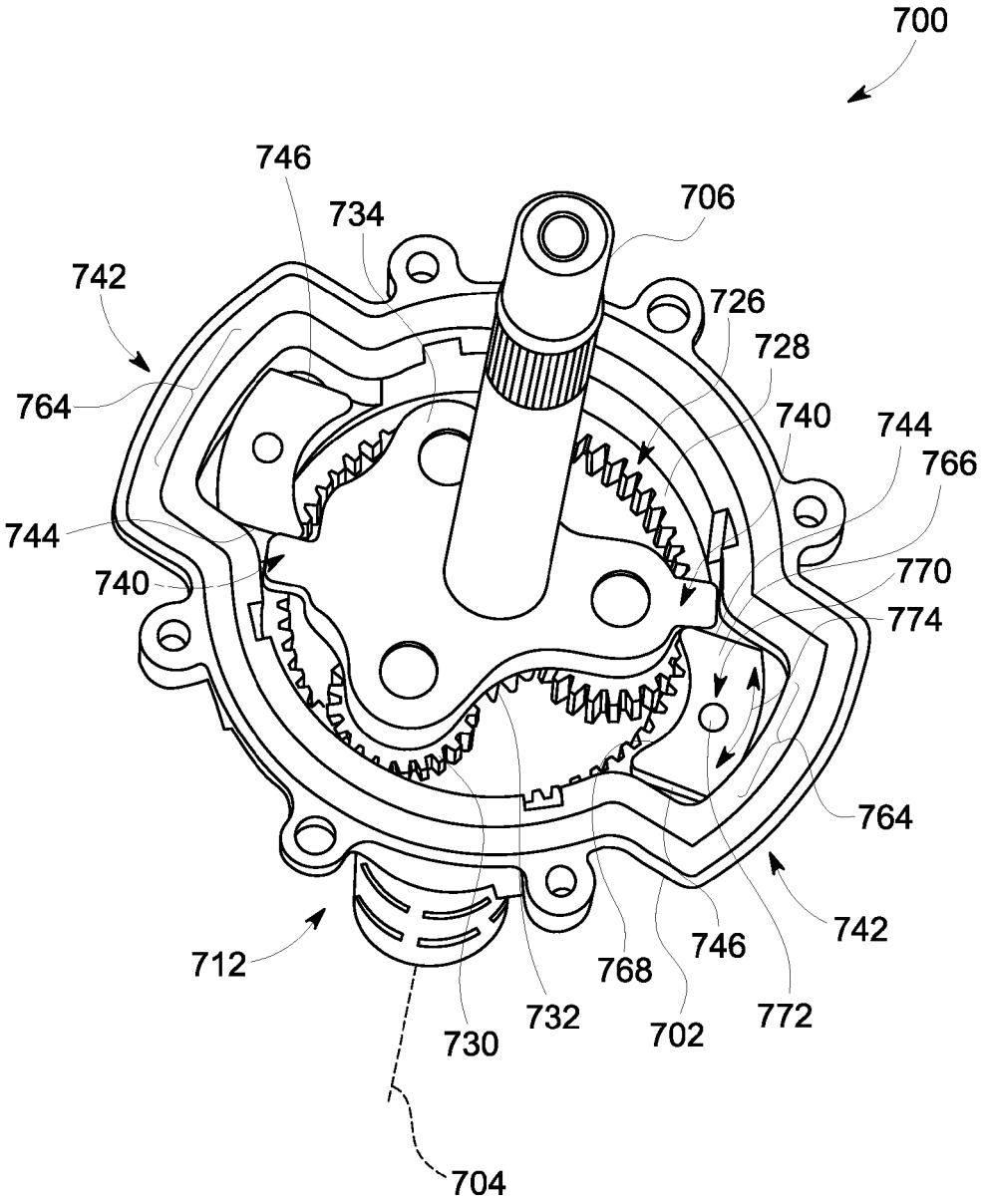
FIG. 10 is a top, perspective view of yet another example of a drive system for use in an appliance such as the appliances of FIGS. 1-4.
Figure 11:
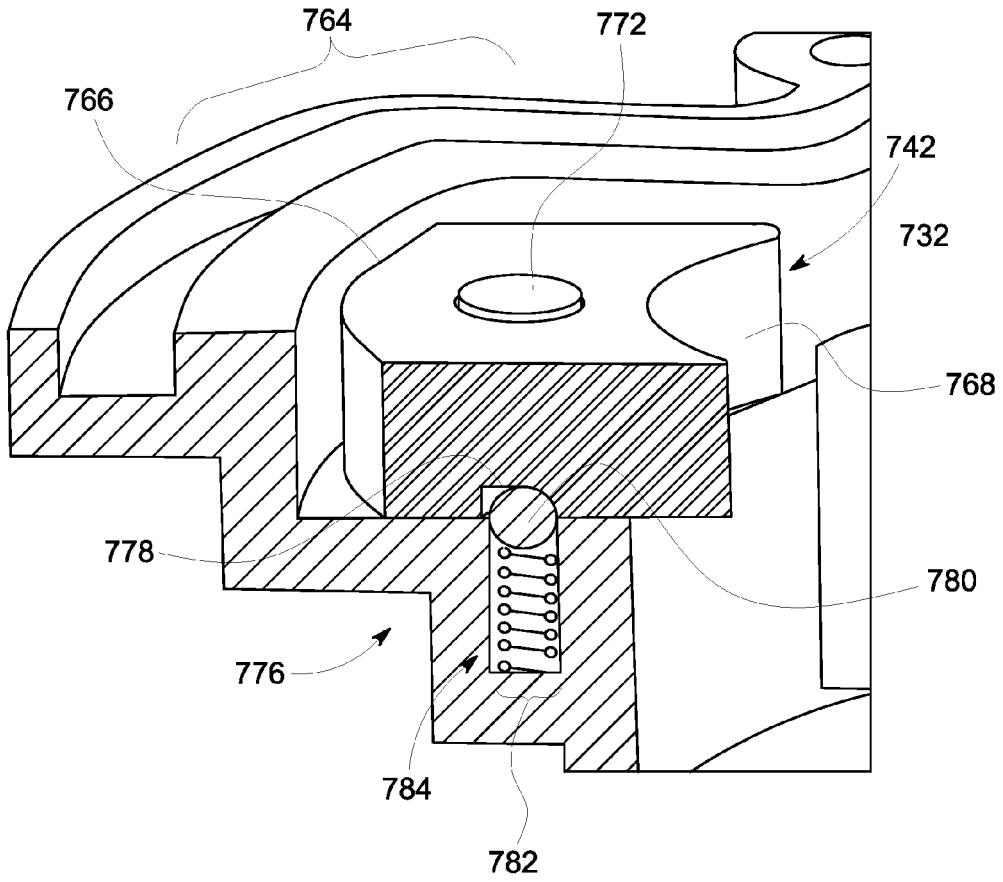
FIG. 11 is a side, partial cross-section view of the drive system of FIG. 10.

FIGS. 10 and 11 illustrate another example of a drive system 700. Like numerals are used to identify like components as between FIGS. 6 and 7 and 10 and 11, but the numerals in FIGS. 10 and 11 are increased by 300 (e.g., 400 is now 700). For example, the drive system 700 comprises an outer housing 702 with a center axis 704, a shaft 706, and a lower housing element 712. The drive system 700 also comprises a planetary gear train 726 that includes a ring gear 728, planet gears 730, and a sun gear 732. Also shown is a carrier plate 734 with engagement features 740 that are configured to engage stops 742. Engagement can occur on a first face 744 (or "clockwise face 744") and a second face 746 (or "counter-clockwise face 746").

Focusing on the stops 742, each comprises a lever assembly 764 that is configured to change the position of the first face 744 and the second face 746 in response to contact by the engagement features 740. The lever assembly 764 includes a lever 766 with a contact surface 768 and on which is disposed the first face 744 and the second face 746. The lever assembly 764 also includes a pivot 770 such as a pin 772 about which the lever 766 rotates, as generally denoted by the numeral 774. The pin 772 can be secured to the outer housing 702 such as by press-fit or mechanical fastener. Alternative constructions are also considered in which the pin 772 (and the pivot 770) is generally manufactured as part of the outer housing 702 or the lever 766. These are not, however, the only construction as still other constructions will be recognized that are compatible with and permit rotation 774 as discussed herein.

As best depicted in FIG. 11, the lever assembly 764 is configured in one embodiment to limit the relative motion of the lever 766. This feature is provide in the lever assembly 764 by a locking mechanism 776, which comprises a detent 778 in the form a slot in the lever 766, a ball 780, a bore 782, and a spring 784. In one implementation, the spring 784 is sized and configured to provide an upwardly-directed force that causes the ball 780 to engage the detent 778. This force is sufficient enough to maintain the position of the lever 766, thereby preventing the rotation 774 of the lever 766 unless otherwise acted upon by the engagement features 740.

Figure 12:
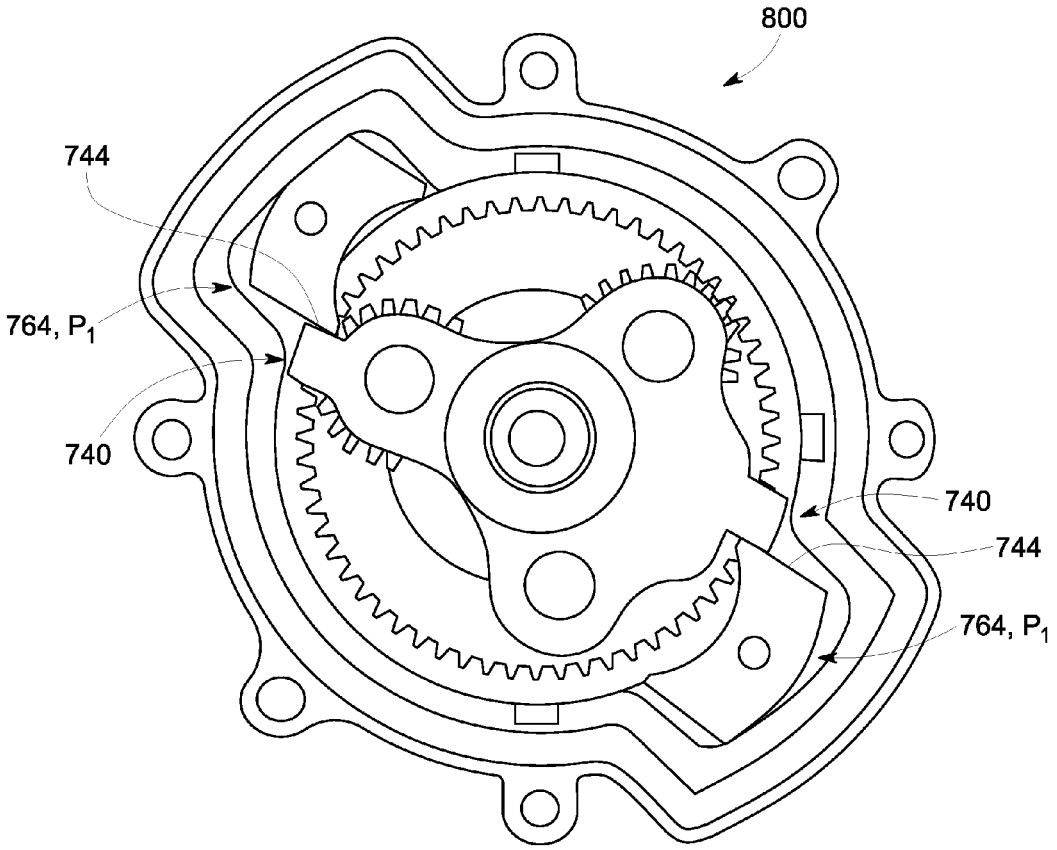
FIG. 12 is a top view of the drive system of FIGS. 10 and 11 in a first contact position.
Figure 13:
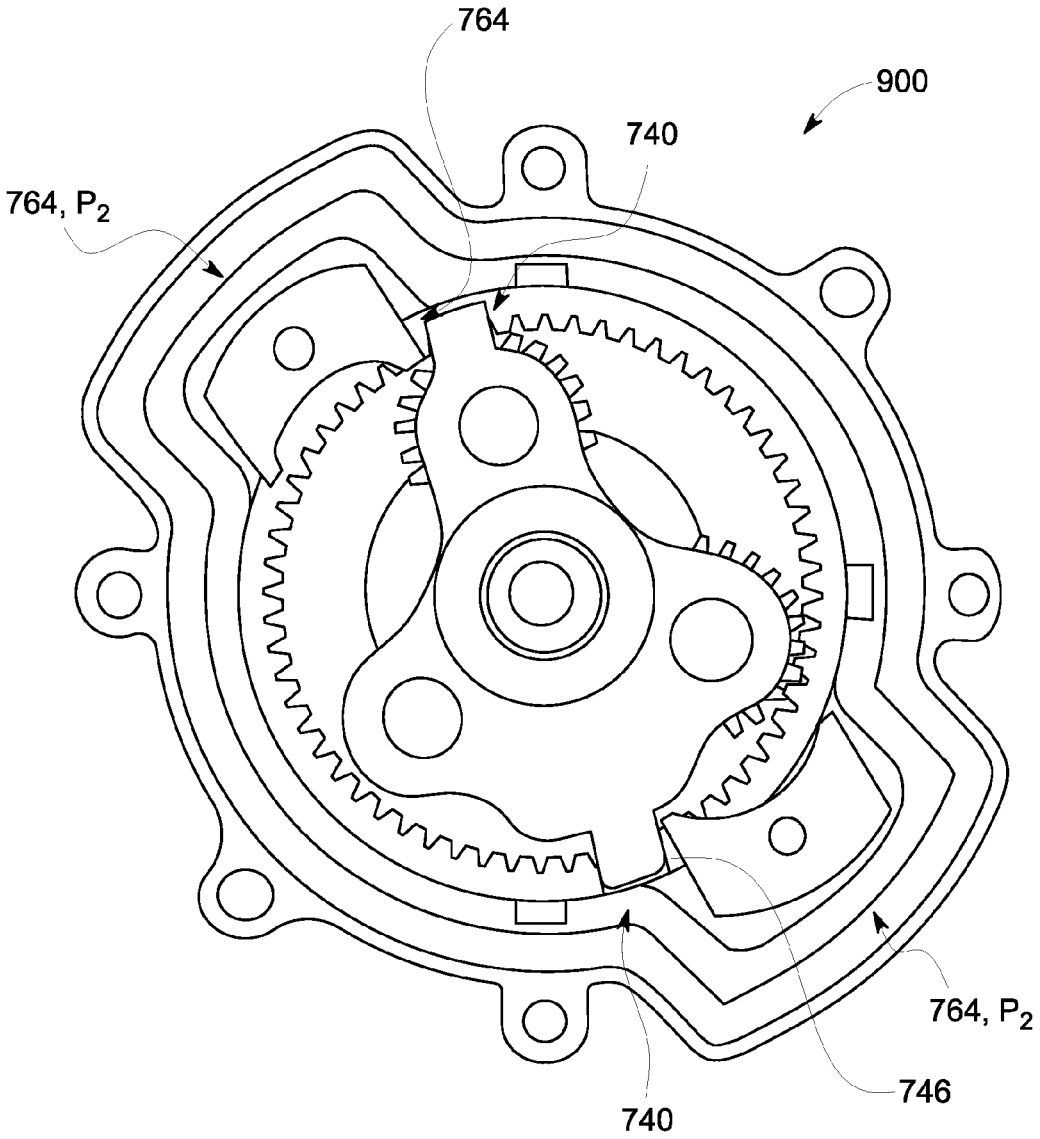
FIG. 13 is a top view of the drive system of FIGS. 10 and 11 in a second contact position.

Turning next to FIGS. 12 and 13, and with continued reference to FIGS. 10 and 11, the actuation of the lever assembly 764 is illustrated as it relates to the position of the engagement features 740, and more particularly to a first contact position 800 (FIG. 12) and a second contact position 900 (FIG. 13). In FIG. 12, each of the lever assembly 764 is shown in a first rotated position $P_1$ that permits contact between the engagement features 740 and the stops 742 on the first face 744. FIG. 13 on the other hand illustrates each of the lever assembly 764 in a second rotated position $P_2$ that permits contact between the engagement features 740 and the stops 742 on the first face 744.

Rotation (e.g., rotation 774) of the lever 766 occurs in response to contact between the contact surface 768 and the engagement features 740 (FIG. 9). This contact overcomes the frictional force exerted by the locking mechanism 776, thereby causing to rotate the lever 766 such as from the first rotated position $P_1$ to the second rotated position $P_2$. Moreover, as is evident by comparing the FIGS. 11 and 12, changes in the position of the lever 766 promotes contact between the engagement features 740 and either the first face 744 and the second face 746. This configuration is beneficial to facilitate rotation of the engagement features 740 of more than 360° and upwards of about 680° as between the first contact position 800 (FIG. 12) and the second contact position 900 (FIG. 13). In one embodiment, coupled rotation of the agitation device and the wash basket occurs with continued rotation of the engagement features 440 through each of the first contact position 800 (FIG. 8) and the second contact position 900 (FIG. 9).

Where applicable it is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defied by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus used to rotate elements in an appliance, comprising:
   - a drive system comprising an outer housing;
   - a shaft extending through the outer housing;
   - a first stop and a second stop affixed to an inner surface of the outer housing; and
   - a first carrier arm coupled to the shaft and a second carrier arm coupled to the shaft, each carrier arm radially offset from the shaft and longitudinally offset from each other relative to the longitudinal axis of the shaft, the first carrier arm coupled to a first engagement feature and the second carrier arm coupled to a second engagement feature,
   - wherein the first engagement feature contacts the first stop and the second engagement feature contacts the second stop.

2. An apparatus according to claim 1, further comprising a planetary gear train that comprises a sun gear secured to the shaft and a ring gear positioned inside of the outer housing to engage one or more planet gears that are coupled to the sun gear.

3. An apparatus according to claim 1, wherein the shaft is configured to rotate the engagement features from a first contact position to a second contact position that is separated from the first contact position by an angle that exceeds about 180°.

4. An apparatus according to claim 3, wherein the angle is from about 360° to about 680°.

5. An apparatus according to claim 1, wherein the first stop and the second stop are located on the longitudinal axis that is perpendicular to and passes through a center axis on which the shaft is aligned.

6. An apparatus according to claim 1, wherein the first stop and the second stop are configured to move in response to contact by the engagement features.

7. An apparatus according to claim 6, wherein each of the first stop and the second stop are configured to rotate about a pivot for contact with the engagement features.

8. An apparatus according to claim 1, wherein the shaft defines an outer surface, the engagement features extending from the outer surface.

9. An apparatus according to claim 1, wherein the outer housing is configured to retain a lubricant therein.

10. An apparatus according to claim 1, wherein the first stop and the second stop are longitudinally offset relative to each other.

* * * * *